US010011395B2

(12) United States Patent
Eberhard

(10) Patent No.: US 10,011,395 B2
(45) Date of Patent: Jul. 3, 2018

(54) DELIVERY BAG

(71) Applicant: Papier-Mettler KG, Morbach (DE)

(72) Inventor: Patrick Eberhard, Morbach-Hundheim (DE)

(73) Assignee: Papier-Mettler KG, Morbach (DE)

( * ) Notice: Subject to any disclaimer, the term of this patent is extended or adjusted under 35 U.S.C. 154(b) by 0 days.

(21) Appl. No.: 14/928,932

(22) Filed: Oct. 30, 2015

(65) Prior Publication Data

US 2016/0122084 A1 May 5, 2016

(30) Foreign Application Priority Data

Oct. 31, 2014 (EP) ..... 14191360

(51) Int. Cl.
*B65D 33/08* (2006.01)
*B65D 33/18* (2006.01)
(Continued)

(52) U.S. Cl.
CPC ..... *B65D 33/08* (2013.01); *B31B 50/26* (2017.08); *B31B 50/81* (2017.08); *B31B 50/86* (2017.08);
(Continued)

(58) Field of Classification Search
CPC ..... B65D 33/08; B65D 75/566; B65D 31/10; B65D 33/065; B65D 33/007; B65D 33/18;
(Continued)

(56) References Cited

U.S. PATENT DOCUMENTS 4,337,889 A * 7/1982 Moertel ..... B65D 33/25 383/119
4,471,875 A * 9/1984 Hain ..... B65D 33/18 383/211
(Continued)

FOREIGN PATENT DOCUMENTS

DE 10 2009 007 985 A1 2/2010
DE 20 2012 006 901 U1 8/2012
(Continued)

OTHER PUBLICATIONS

Search Report for application EP14191360.8 dated Apr. 17, 2015, 7 pages.

*Primary Examiner* — Peter Helvey
(74) *Attorney, Agent, or Firm* — Seed IP Law Group LLP

(57) ABSTRACT

The present disclosure relates to a delivery bag, wherein the front wall of the bag and the rear wall of the bag are connected between the upper end of the bag and the lower end of the bag by at least one connecting element, which extends at least partially in the direction from the first edge of the bag to the second edge of the bag, in particular a first welded seam and/or an adhesion line, to form a first bag section containing the upper end of the bag, and a second bag section containing the lower end of the bag, and wherein the first section of the bag comprises at least one area for holding goods and the second section of the bag comprises at least one weakened zone for a handle hole. The present disclosure further relates to a method for producing the delivery bag according to the invention, and to the use of the delivery bag according to the present disclosure for the transportation of goods for delivery, in particular goods for delivery for online or mail order trading.

33 Claims, 4 Drawing Sheets

(51) Int. Cl.

| | |
|---|---|
| ***B65B 5/02*** | (2006.01) |
| ***B65D 33/00*** | (2006.01) |
| ***B31B 50/26*** | (2017.01) |
| ***B31B 50/86*** | (2017.01) |
| ***B31B 50/81*** | (2017.01) |
| ***B31B 70/14*** | (2017.01) |
| *B31B 160/10* | (2017.01) |

(52) U.S. Cl.
CPC ..... *B31B 70/14* (2017.08); *B65B 5/022* (2013.01); *B65D 33/007* (2013.01); *B65D 33/18* (2013.01); *B31B 2160/10* (2017.08)

(58) Field of Classification Search
CPC .. B29C 66/71; B31B 1/26; B31B 1/86; B31B 1/90; B31B 19/14; B65B 5/022
USPC ..... 383/7, 10, 84, 86
See application file for complete search history.

(56) References Cited

U.S. PATENT DOCUMENTS 4,567,987 A * 2/1986 Lepisto ..... B65D 75/68 383/205
4,759,643 A * 7/1988 Canno ..... B65D 27/16 383/100
4,846,587 A * 7/1989 Hull ..... B65D 33/08 206/806
4,946,289 A * 8/1990 Bolling ..... B65D 33/24 383/204
5,338,118 A * 8/1994 DeMatteis ..... B65D 33/08 383/10
6,315,448 B1 * 11/2001 Thrall ..... B65D 31/02 383/109
8,297,840 B2 * 10/2012 Jansen ..... B65D 33/22 383/117
8,790,009 B2 * 7/2014 Saville ..... B31B 1/00 383/10
9,233,502 B2 * 1/2016 Sargin ..... B29C 65/4815
2003/0138170 A1 * 7/2003 Breil, Jr. ..... B65D 33/2533 383/59
2005/0036716 A1 * 2/2005 Geyer ..... B65D 33/34 383/5
2005/0053313 A1 3/2005 Lucas et al.
2005/0105832 A1 * 5/2005 Trinko ..... B65D 31/12 383/84
2008/0152264 A1 * 6/2008 Pokusa ..... B65B 9/067 383/5
2010/0142859 A1 * 6/2010 Cushman ..... A47J 43/27 383/10
2010/0296754 A1 11/2010 Chiu
2013/0182975 A1 7/2013 Ochoa Marin
2013/0315507 A1 * 11/2013 Teixido Vidal ..... B65D 33/08 383/10
2014/0270584 A1 * 9/2014 Exner ..... B65D 75/5838 383/61.1
2015/0055892 A1 * 2/2015 Exner ..... B65D 75/566 383/86

FOREIGN PATENT DOCUMENTS

DE 20 2012 010 643 U1 2/2013
GB 1 455 570 A 11/1976

* cited by examiner

DELIVERY BAG

BACKGROUND

Technical Field

The present disclosure relates to a delivery bag and a method for producing delivery bags. The present disclosure further relates to the use of such a delivery bag for transporting goods for dispatch.

Description of the Related Art

Delivery bags are used in widely differing forms for delivery purposes. In contrast to standard shopping bags, such delivery bags frequently comprise a closable opening, wherein the intention in most cases is that goods for delivery should not be seen, and furthermore, should be protected during transportation. Often, such delivery bags have no handle hole. However, plastic bags such as those usually provided in supermarkets frequently have a handle hole. Delivery bags with a carrier handle are also known, e.g., from DE 10 2009 007 985.

In delivery bags, handle holes are usually avoided. They are produced—if they are indeed present—by stamping a handle hole into the area designed to hold the articles for delivery in the delivery bag. A considerable disadvantage of standard delivery bags is that they are frequently not sufficiently protected against the weather in order to be able to withstand heavy rain, for example. Shopping bags are usually open in the direction of the handle holes, and are thus unsuitable for use as delivery bags. This problem is resolved in delivery bags without handle holes by sealing them completely. Here, handle holes are consciously avoided in order to avoid impairing the sealing of the goods. As a result of a handle hole, the contents are exposed to the environmental conditions, in particular environmental humidity, a state which should be avoided in delivery bags.

Alternatively, handles can be adhered or welded to the outside surface of a delivery bag. This requires a further, cost-intensive, production stage, and involves in particular a further welded seam or adhesion line. Due to the large number of delivery bags in circulation, the production costs in this regard should be regularly and carefully calculated.

The front wall of the bag and the rear wall of the bag are also usually produced from a thin material in order to reduce said production costs and protect the environment. Handle holes or other attached handles are in these cases usually not sufficiently stably affixed in order to enable secure transportation by carrying by a handle hole or handle. Here, it is disadvantageous that handle holes are not usually sufficiently stabilized by the surrounding material. They are even regularly applied to weak points, such as the opening of a delivery bag. Thus, the problem of low load-bearing capacity is increased as a result. Particularly in light of the fact that expensive brand clothing for women and/or men is frequently dispatched in such delivery bags, for example, this is wholly unacceptable for a mail-order company. Further, it is disadvantageous that due to the tensile load, the closure of a delivery bag can also open unintentionally.

BRIEF SUMMARY

Embodiments of the present disclosure thus include a delivery bag designed in such a manner that the disadvantages described above are overcome. In particular, embodiments of the present disclosure are designed to protect the contents of the delivery bag with handle holes from humidity, for example in the form of rain. Further, the delivery bag with a handle hole should enable simple, accident-free, protected transportation of the contents. Additionally, the production costs of the delivery bag according to the present disclosure should be low. Embodiments of the present disclosure also make available a bag with which the contents can be protected against manipulation and damage, in particular against uncontrolled access by unauthorized third parties. Furthermore, embodiments of the present disclosure provide delivery bags which are very user-friendly, and which at the same time can be produced in an unproblematic, low-cost and process-optimized manner. Finally, embodiments of the present disclosure provide delivery bags which guarantee optimum comfort of use for mail-order trading companies.

BRIEF DESCRIPTION OF THE SEVERAL VIEWS OF THE DRAWINGS

Further features and advantages of the present disclosure are presented in the description below, in which preferred embodiments of the present disclosure are explained as examples with reference to schematic drawings, in which.

DETAILED DESCRIPTION

Figure 1A:
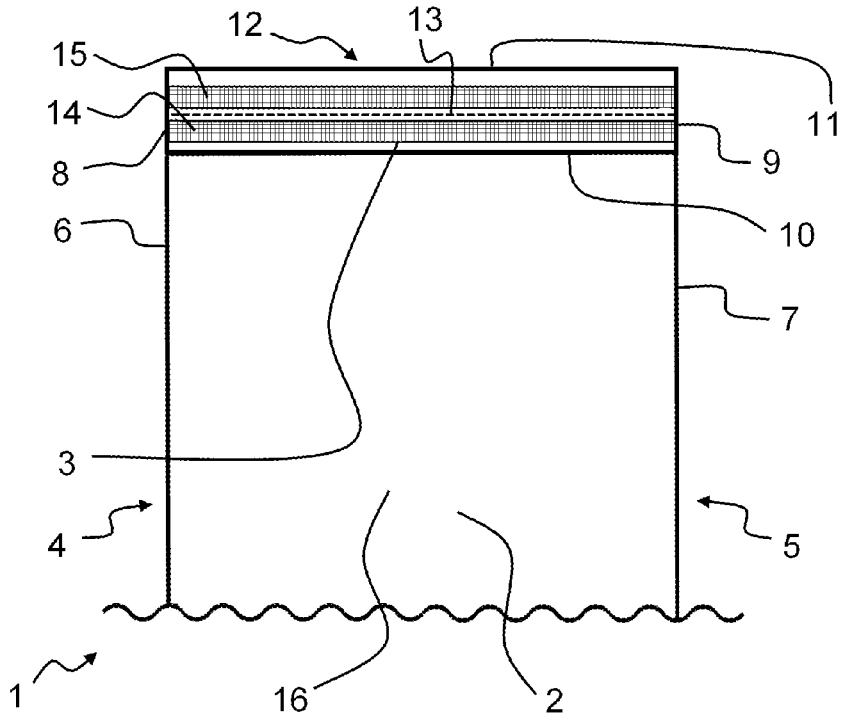
FIGS. 1A-1B show schematic front view of different embodiments of the upper half of the delivery bag.

In various embodiments, described herein is a delivery bag comprising an upper bag end, an opposite lower bag end, a first bag edge, and an opposite second bag edge, together with a bag front wall and an opposite bag rear wall, wherein the bag front wall and the bag rear wall respectively contain an upper edge, a lower edge, a first side edge, and a second side edge, and are respectively restricted by these, wherein the front wall of the bag and the rear wall of the bag are connected between the upper end of the bag and the lower end of the bag by at least one connecting element which extends at least partially in the direction from the first edge of the bag to the second edge of the bag, in some cases by a first welded seam and/or an adhesion line, to form a first section of the bag containing the upper end of the bag, and a second section of the bag containing the lower end of the bag, wherein the first section of the bag comprises a least one area for holding goods, and the second section of the bag comprises a weakened zone for a handle hole.

In various embodiments, the weakened zone for a handle hole is formed by a circumferential weakened line which describes a handle hole, in some cases a perforated line, or by a weakened line, in some cases a perforated line, which is not fully circumferential.

Accordingly, a weakened zone for a handle hole can be a weakened zone, for example in the form of a perforated line, to form a handle hole in the sense of the present disclosure. In some cases, it can, for example, be sufficient in order to form a handle hole when the perforation is partially destroyed. When the weakened or perforated line is not fully circumferential, but instead leaves out an area, the bag material pressed out of the weakened area can remain on the bag itself when the handle hole is opened, and does not contribute to pollution of the environment, and also does not need to be disposed of separately. To a far greater extent it can, as a component of the delivery bag, be re-used following the first use together with the rest of the bag. Designs for handle holes can thus be unproblematically transferred to weakened zones for handle holes. The embodiment with the weakened zone for a handle hole can, in each case, best be transferred shortly before use by the user or carrier of the delivery bag to an embodiment with a handle hole by destroying the weakened zone for a handle hole. Surprisingly, due to the fact that during production of the delivery bags according to the present disclosure there are no handle holes, but instead only weakened zones for handle holes, the share of rejections during production is reduced considerably. The comfort of use on the sides of the bag is also considerably increased for the mail-order trading company using these delivery bags. For example, the filling and/or transportation of the delivery bags, including transportation on conveyor belts, is also considerably less prone to error.

In various embodiments, a handle hole in the sense of the present disclosure is usually a long opening in a flat single- or multi-layer material, in some cases a two-layer material with a bag front wall layer and a bag rear wall layer, which is designed and arranged in order to facilitate the carrying of the bag. In particular, the handle hole can be an opening in the front wall of the bag and the rear wall of the bag, designed and arranged in order to facilitate the carrying of the bag. Even though two openings are created in this embodiment (one in the front wall of the bag and the rear wall of the bag respectively), only one handle hole is produced when the openings of the front wall of the bag and the rear wall of the bag are arranged opposite each other (which is usually the case). This is usually already achieved during production when the opening or weakened zone for a handle hole is created simultaneously in both films by a single working procedure.

A connecting element in the sense of the present disclosure connects two material layers. Such a connecting element can, for example, be a sewn seam or a welded seam. Preferably, in particular with delivery bags made of synthetic material, this is a first welded seam. A delivery bag according to the present disclosure is preferably a delivery bag made of synthetic material with at least one first welded seam. A connecting element can also comprise an adhesion line. With such an adhesion line, two material layers are connected to each other by a line- or strip-shaped, preferably continuously applied, glue. The connecting element, e.g., the first welded seam and/or the adhesion line, preferably extends from the first edge of the bag through to the opposite second edge of the bag.

Surprisingly, it is also shown herein that it is advantageous when the access opening to the area for holding goods is not provided in the second section of the bag. Access openings for positioning articles in the area for holding goods are regularly material weak points in the structure of a delivery bag, although in the present disclosure they do not, or if so, only insignificantly, influence the stability of the punch-through hole. Due to the application of the at least one weakened zone for a handle hole, or the at least one handle hole, in an area which is at least partially, and in some cases fully separated by the connecting element, the first welded seam and/or the adhesion line, the material strength can surprisingly be increased considerably. In particular, such a seam and/or adhesion line can lead to improved distribution of the tensile forces originating in the handle hole. Further, due to the weakened zone for a handle hole according to the present disclosure, no hole is created in the wall of the at least one area for holding goods. As a result, impurities or humidity cannot enter into the area for holding goods through the weakened zone for a handle hole or the handle hole which results from it.

In various embodiments, a delivery bag in the sense of the present disclosure is a bag which is provided for transporting goods, in particular mail-order delivery goods. A delivery bag of this type is usually closable, preferably in such a manner that no opening remains unclosed. The delivery bag usually comprises at least one area for holding goods with an opening which can advantageously be fully closed. Bags which comprise unclosable openings, which permit articles for delivery to fall out unintentionally during transportation, are as a rule unsuitable for use as delivery bags. It is fundamentally feasible to deform a delivery bag in such a manner that a precise description of the geometry of such a bag is no longer possible. It should therefore be stated in advance with regard to further embodiments of the present disclosure that the description relates to an unfilled, non-deformed state of the delivery bag, wherein the delivery bag should preferably be regarded as being extended flat. This is usually the form in which the delivery bag is provided prior to being filled with articles for delivery.

In a particularly preferred embodiment, the delivery bag is a bag made of synthetic material. Preferably, the front wall of the bag and/or the rear wall of the bag comprise at least one thermoplastic synthetic material. In particular, it is preferred that the front wall of the bag and/or the rear wall of the bag is formed from or consists of at least one thermoplastic synthetic material. Experience has shown that particularly suitable synthetic materials are polyester and/or polyolefins. Synthetic materials, in particular those synthetic materials named above, are usually more tear-resistant than alternative materials such as paper. Furthermore, delivery bags made of synthetic material are very light and preferably watertight, which is advantageous during dispatch.

Preferably, at least one wall of the bag, in particular the front wall of the bag and/or the rear wall of the bag, is made of synthetic material that is watertight and/or light-tight. Here, light-tight means that the light intensity is significantly reduced by the respective wall of the bag, in some cases by at least 30%, in other cases by at least 50%, and in yet other cases, by at least 70%. The water tightness serves to protect the articles for delivery, in particular against weather-related influences such as rain, snow or air humidity. The reduction in the level of light intensity also serves as protection, particularly against UV bleaching, while also being important in order to ensure that postal confidentiality requirements are met if necessary.

In at least one preferred embodiment, the front wall of the bag and the rear wall of the bag are made of the same material, in particular from the same thermoplastic synthetic material. Here, it is particularly preferred when the front wall of the bag and the rear wall of the bag are based on one continuous section of a continuous material strip, in particular on a continuous synthetic material film, wherein preferably the front wall of the bag is also a component of said section of a continuous material strip. Preferably, the front wall of the bag and the rear wall of the bag in this embodiment are formed entirely from said continuous section of a continuous synthetic material film, and are only separated from each other by a folding edge. The folding edge in this case also forms the lower edge of the front wall of the bag and the rear wall of the bag. Preferably, in this embodiment, the front wall of the bag and the rear wall of the bag are separated from each other by a V-shaped fold in profile (also known as "V-fold"). It is particularly preferred when the lower edge of the front wall of the bag is connected to the lower edge of the rear wall of the bag via a fold with a V-shaped profile. The V-shaped fold is not to be understood as restricting in the sense that the angle between the legs of the V is pre-specified. Preferably, the front wall of the bag and the rear wall of the bag are in contact with each other. The structure described above has an advantage in that production can be considerably simplified and production costs are reduced. In particular, no welded seams are required in this embodiment in order to connect the front wall of the bag and the rear wall of the bag.

Preferably, the weakened zone for a handle hole and the resulting handle hole extend longitudinally, preferably (but not necessarily) parallel to the lower edge. In a particularly preferred manner, the weakened zone for a handle hole and the resulting handle hole are formed as an oval or as a rectangle with rounded corners. It has been shown that the weakened zone for a handle hole or the resulting handle hole is particularly well stabilized by the lower edge, in particular if it is a V-fold, against tensile forces such as those which are common in the generic use or when the delivery bag is being carried.

In a particularly preferred manner, the weakened zone for a handle hole and the resulting handle hole may have an average distance of less than 5 cm, in some cases less than 4 cm, and in other cases less than 3 cm, from the connecting element, which may be the first welded seam and/or the adhesion line. This is advantageous since as a result, the tensile forces such as those common in a generic use of the bag or when the delivery bag is being carried, are distributed, e.g., by the first welded seam and/or the adhesion line so that stabilization results.

In at least one embodiment, the weakened zone for a handle hole and the resulting handle hole have an average distance of less than 5 cm, in some cases less than 4 cm and in other cases, less than 3 cm from the lower edge of the front wall of the bag and/or the rear wall of the bag. This is preferred since a lower distance facilitates an all-encompassing hold. At the same time, the distance is preferably greater than 0.5 cm, and in some cases 1 cm. This has an advantage that the stability of the film area between the weakened zone for a handle hole or the resulting handle hole and the lower edge of the front wall of the bag and/or the rear wall of the bag is sufficiently high.

In at least one embodiment, the connecting element which separates the first and second sections of the bag is a first welded seam, in particular a thermoplastic welded seam. A welded seam in the sense of the present disclosure is preferably created by heating or melting (on) a narrow film area of a thermoplastic synthetic material, in particular to a temperature higher than the glass transition temperature. Through the application of pressure, a connection is thus obtained between the now welded parts following cooling down. It has been shown that welded seams are particularly well suited for connecting the front wall of the bag and the rear wall of the bag in a low-cost, secure manner.

Preferably, the connecting element, in particular the first welded seam and/or the adhesion line, restricts the area for holding goods in the direction of the lower end of the bag. In particular, a first welded seam between the first and second section, which restricts the area for holding goods in a watertight manner in the direction of the lower end, is preferred. In this case, water, even if it does penetrate the weakened zone for a handle hole or the handle hole which results from it, does not reach the area for holding goods.

In at least one embodiment of the delivery bag according to the present disclosure, the connecting element, in particular the first welded seam and/or the adhesion line, runs in a linear manner, preferably essentially parallel to the lower edge of the front wall of the bag and/or the rear wall of the bag. A connecting element of this type, in particular the first welded seam and/or the adhesion line, can be produced particularly easily and at particularly low cost. Furthermore, such a connecting element, in particular such a welded seam and/or an adhesion line, distributes the tensile forces particularly effectively. Additionally, a linear floor end (formed by conjoining the front wall of the bag and the rear wall of the bag at, e.g., the first welded seam and/or adhesion) is provided for the area for holding goods on the inside, so that a particularly appropriate amount of space can be provided for the goods.

In a preferred alternative embodiment, the connecting element, in particular the first welded seam and/or the adhesion line, runs as a curve, at least in sections. Here, it is advantageous when the connecting element connects via at least two connecting points (also referred to below as the first and second connecting point) to the lower edge and/or to at least one side edge of the front wall of the bag and/or the rear wall of the bag, in particular of the front wall of the bag and the rear wall of the bag. Preferably, the at least two connecting points are the two ends of a first welded seam and/or adhesion line. Preferably, the connecting element comprises precisely two connecting points on the lower edge and/or at least one side edge of the front wall of the bag and/or the rear wall of the bag.

The connecting element in this embodiment preferably runs starting from the lower edge of the front wall of the bag and/or the rear wall of the bag, in particular in such a manner that the first and second connecting points are located on the lower edge of the front wall of the bag and/or the rear wall of the bag. Further, it is preferred when said connecting points or ends are connected to the lower edge, in each case at a distance from the first edge of the bag and the second edge of the bag, in some cases at a distance of greater than 1 cm, and in other cases greater than 2 cm.

In a further embodiment according to the present disclosure, the first connecting point is located on the lower edge of the front wall of the bag and/or the rear wall of the bag, and the second connecting point of the connecting element, which runs in a curve at least in sections, is located on the first side edge or the second side edge of the front wall of the bag and/or the rear wall of the bag. In a further preferred embodiment, the first connecting point of the connecting element which runs in a curve at least in sections lies on the first side edge, and the second connecting point lies on the opposite second side edge of the front wall of the bag and/or the rear wall of the bag.

According to the present disclosure, the first edge of the bag is preferably formed by welding the first side edges of the front wall of the bag and the rear wall of the bag to a second welded seam and the second edge of the bag is formed by welding the second side edges of the front wall of the bag and the rear wall of the bag to a third welded seam. This is advantageous since, in this manner, the area for holding the goods for articles to be delivered is maximized.

In an alternative embodiment, the welded seams do not coincide with the first and second side edges, but are at a distance from these edges, in particular at a slight distance. In this embodiment, it is preferred that the first edge of the bag comprises a first welded seam which runs at a first average distance from the first side edges of the front wall of the bag and the rear wall of the bag, and the second edge of the bag comprises a second welded seam which runs at a second average distance from the second side edges of the front wall of the bag and the rear wall of the bag. Preferably, the first average distance and the second average distance are equal. Further, it is preferred that the first average distance and/or the second average distance is less than 3 cm, in some cases less than 2 cm, and in other cases less than 1 cm. Welded seams which are not located directly on the side edges frequently have increased stability.

Preferably, the second section of the bag in the front wall of the bag and the rear wall of the bag, in particular circumferentially, has no openings. In a particularly advantageous embodiment, this second section of the bag is essentially rectangular, wherein all four edges of the rectangle are closed. This has an advantage that water cannot enter into the area for holding goods through the weakened zone for a handle hole or the handle hole which results from it. Furthermore, the tensile stability of the weakened zone for a handle hole or the handle hole which results from it is far greater when it is enclosed by an edge-sealed second section of the bag.

Preferably, the second section of the bag extends transversely, in particular in the direction from the first edge of the bag to the second edge of the bag, and is restricted in its longitudinal area extension by the lower end of the bag and the connecting element, in particular the first welded seam. Experience has shown that welded seams for a longitudinal second section of the bags are easier to produce. In a longitudinal second section of the bag, there is also sufficient space available for a weakened zone for a handle hole, wherein this preferably also comprises a longitudinal extension which is in particular aligned in the same way. In at least one embodiment, the second section of the bag is restricted in its transverse area extension by the first edge of the bag and the second edge of the bag. This makes production easier. Separate restriction of the second section of the in its transverse extension in this case is not required. In a section of the bag of such a type, a tensile load on the weakened zone for a handle hole or the handle hole which results from it is, as experience has shown, distributed over a larger area, which benefits the tensile stability of the handle hole.

In particularly preferred embodiments, the part of the rear wall of the bag which lies in the second section of the bag takes up not more than 30%, in some cases not more than 25%, and in other cases, not more than 20% of the entire rear wall of the bag. Experience has shown that a higher area requirement of the second section of the bag disadvantageously limits the area for holding goods. The weakened zone for a handle hole or the handle hole which results from it usually also comprises at least two layers, in particular the front wall of the bag and the rear wall of the bag, wherein the opening or weakened zone in the front wall of the bag is usually aligned in the same direction and has the same shape as the opening or weakened zone in the rear wall of the bag. When the second section of the bag is not too large, these two openings can better come into contact with each other.

Experience has shown that the delivery bag comprises at least one opening (first opening) to the area for holding goods. Preferably, this is an opening which is arranged in the first section of the bag. In preferred embodiments, the first opening is located in the first section of the bag in the front wall of the bag or in the first section of the bag in the rear wall of the bag. Particularly preferred are embodiments with which the first opening is located between the front wall of the bag and the rear wall of the bag in the first section of the bag. Preferably, the first opening is arranged opposite the end of the bag wall on which the weakened zone for a handle hole or the handle hole which results from it is located. In a particularly preferred manner, the first opening in this case is arranged between the upper edges of the front and rear side. A corresponding delivery bag is easier to produce. Further, the large distance between the weakened zone for a handle hole or the handle hole which results from it and the first opening of the area for holding goods has the effect that the lower tensile stability of the delivery bag in the area of the first opening of the area for holding goods does not significantly impair the tensile stability of the handle hole or the handle hole which results from the weakened zone for the handle hole.

In a preferred embodiment, the front wall of the bag has a first length which corresponds to the average distance between the first and second side edge of the front wall of the bag, and the rear wall of the bag preferably has a second length which corresponds to the average distance between the upper edge and the lower edge of the rear wall of the bag. Preferably, the first length is here shorter than the second length, so that the rear wall of the bag in particular protrudes on the upper end of the bag over the front wall of the bag. This is advantageous since the section of the rear wall of the bag which protrudes can preferably be folded over in order to preferably close the first opening.

In a particularly preferred embodiment, the first opening is arranged on the upper end of the bag and can be closed by way of the fact that a section of the rear wall of the bag, in particular the section which protrudes over the front wall of the bag, can be folded over onto the front side.

It has also been shown to be advantageous when the rear wall of the bag is larger than the front wall of the bag, preferably however being not larger than the front wall of the bag by more than 30%, in some cases not more than 25%, and in other cases, not more than 20%. Generally, as a result, a protruding section of the rear wall of the bag is created which can be used on the front wall of the bag to close an opening to the area for holding goods, preferably the first opening. It has been shown that the percentage difference in size described above provides sufficiently large sections in order to guarantee secure closure. Areas which are too large can possibly be far more difficult to affix.

The front wall of the bag preferably also has a first width which corresponds to the average distance between the first and second side edge of the front wall of the bag, and the rear wall of the bag preferably has a second width which corresponds to the average distance between the first and second side edge of the rear wall of the bag. In this embodiment, the width of the front wall of the bag is less than the length of the front wall of the bag, and the width of the rear wall of the bag is less than the length of the rear wall of the bag. This has an advantage that the handle hole or weakened zone for a handle hole is arranged on the shorter section of the delivery bag, which leads to greater stability.

Preferably, the at least one opening to the area for holding goods of the delivery bag, in particular the rear wall of the bag, comprises at least one fastener, wherein said fastener, is designed to close an opening to the area for holding goods, in particular following the folding-over of the rear wall of the bag onto the front wall of the bag. Alternatively or in addition, the front wall of the bag can also comprise at least one fastener in order to close said opening. By folding over, the bag is only deformed to a slight degree, so that documents are not creased, for example. In particular, an opening which uses a drawstring, for example, in order to narrow the opening through to full closure, would be less suitable for documents in many cases.

Preferably, the first opening can be closed with at least one adhesive strip. This strip would preferably extend along the top end of the bag, in particular along (and if appropriate, at a distance from) the upper edge. In a preferred embodiment, the adhesive strip extends from the first edge of the bag to the second edge of the bag. Adhesive strips enable rapid, secure sealing.

In a preferred embodiment, the closable opening can be closed using a fastener, preferably with at least one adhesive strip, in cases irreversibly, wherein preferably, the rear wall of the bag on the inside and/or the front wall of the bag on the outside comprises said fastener, in particular in such a manner that they come into contact with the front wall of the bag or the rear wall of the bag if a section of the rear wall of the bag is folded onto the front wall of the bag.

The adhesive strips preferably have a width of between 0.3 cm and 3 cm, and in some cases between 0.5 cm and 2 cm. Due to the suitable width, secure closure of the opening is ensured, wherein in particular, unintentional opening of the delivery bag is avoided. In a further preferred embodiment, the closable opening of the upper end of the bag can be irreversibly closed. This is advantageous since in this manner, it is ensured that the opening cannot be opened during transportation, in particular during carrying using a handle hole.

Particularly preferred are embodiments in which the at least one fastener comprises two adhesive strips at a distance from each other with a destructible zone, in particular a weakened line, between said adhesive strips. Preferably, these strips are essentially parallel adhesive strips, wherein a destructible film area extends between said adhesive strips. Preferably, the first opening is located between the upper edge of the front wall of the bag and the upper edge of the rear wall of the bag. Thus the adhesive strip which is closer to the top end of the bag can be used in order to close the bag, in particular the first opening, for the first time. The destructible film area can be destroyed in order to re-open the delivery bag. As a result of the destruction of the film area, a second opening is created between the upper edge of the front wall of the bag and the destructible film area, which can essentially be aligned parallel to the original opening (the first opening). Preferably, the former (now closed) first opening and the newly attained second opening are located in direct proximity, i.e., on average not more than 7 cm, and in some cases not more than 5 cm, from each other. The second adhesive strip, which is situated further away from the upper end of the bag, can if necessary be used in order to also close the second opening. In an advantageous embodiment, said film area comprises at least one weakened line or weakened zone between adhesive strips which are at a distance from each other. In a particularly preferred embodiment, the closable opening of the upper end of the bag is irreversibly closable with the adhesive strips described above, wherein a weakened line is provided between the adhesive strips in order to form the second closable opening. Essentially parallel in the sense of the present disclosure means that the deviation from a parallel alignment is less than 10°, preferably less than 5°. Preferably, the average distance between the adhesive strips which are at a distance from each other is less than 9 cm, in some cases less than 7 cm, and in other cases, less than 5 cm.

In at least one embodiment, the delivery bag comprises only one first opening or one first opening and one second opening, so that the area for holding goods for articles for delivery is enclosed when the first opening or the first and second openings are closed, and no humidity/contamination/dirt can enter through further openings. It should be noted that a weakened zone, in particular a weakened line in the form of a perforated line, still does not constitute an opening for inserting and removing goods in the sense of the present disclosure, but is simply an area in which if appropriate, a third opening can be particularly easily created by destroying said weakened zones.

Since the first opening and, if present, the second opening usually points downward according to the present disclosure when being carried by a handle hole, it is advantageous to use an irreversible closure for the first and, if present, second opening, since the possibility of unintentional re-opening is generally excluded. The irreversible closure of the first opening is in particular advantageous when at least one third opening of this nature can be formed without any problems, for example due to the weakened zones, in particular weakened lines. In a preferred embodiment, the front wall of the bag and/or the rear wall of the bag comprises a weakened zone, wherein the destruction of the weakened zone releases the at least one third opening. This enables the formation of the third opening in order to remove an article for delivery. The weakened zone can be a weakened line which is preferably curved or also linear. The presence of a third opening does not imply that the second opening described above necessarily also has to be present. Preferably, the first, second and/or the third opening can be closed with at least one first adhesive strip. The third opening is preferably not arranged in direct proximity to the first opening.

In a preferred embodiment, said weakened zone, in particular the weakened line, is arranged to form the third opening in the rear wall of the bag or the front wall of the bag. Here, it is advantageous if the third opening points sideways during carrying so that any unintentional tearing of the weakened lines during carrying does not lead to the article falling out due to gravity.

The present disclosure also relates to a method for producing a bag, comprising the following method steps, preferably in this sequence:

a) Providing a first film strip or film band made of a thermoplastic synthetic material to form the front wall of the bag and the rear wall of the bag;

b) Folding the film strip or film band along a folding edge, so that a film area connects the front wall of the bag and the rear wall of the bag on the lower end;

c) Forming a connecting element, in particular a welded seam (first welded seam) or adhesion line, essentially parallel to the folding edge, preferably at a distance of 1.5 to 15 cm from the folding edge;

d) Forming at least one weakened zone for a handle hole, in particular by creating at least one perforated line, in the area between the folding edge and the connecting element, in particular the welded seam and the adhesion line;

e) Forming two side edges at a distance from each other (also the first and second side edge), essentially orthogonal to the folding edge, by welding the front wall of the bag to the rear wall of the bag, wherein the film band is if necessary separated on the side edges.

The film band is a continuous synthetic material film band of a production process, which is subdivided at a later point in time into the delivery bag segments. Said point in time is preferably simultaneous with the welding of the side edges. Preferably, the method is used for producing the delivery bag according to the present disclosure as described in the patent claims and in the description.

The present disclosure also relates to the use of a delivery bag according to any one of the preceding claims for the transportation of goods for delivery, in particular goods for delivery for online or mail order trading.

With the present disclosure described above, the disadvantages of delivery bags with handle holes described in the introduction can be avoided. The provision of delivery bags according to the present disclosure with weakened zones for handle holes to form handle holes provides considerable added value not only for delivery companies or parcel deliverers, but also for the manufacturers of such bags. The present disclosure effectively prevents the delivery bag from slipping out of the carrier's hands, making it unlikely that the goods will be dropped. It is also generally more comfortable for the parcel deliverer to carry using a handle hole. This is of particular importance when the parcel deliverer frequently needs to carry delivery bags due to the nature of their job. Through the provision of handle holes which can be created from weakened zones for handle holes, work-related illnesses such as back pain can be prevented. Despite the weakened zones for a handle hole or the handle hole which results from it, the sealing of the area for holding goods against humidity is not impaired. The tensile strength of the handle hole is increased over standard delivery bags. It is also of particular advantage that with the delivery bags according to the present disclosure, the share of rejected bags during production can be significantly reduced. It is assumed that this is due to the fact that no incomplete stamping procedure of the handle hole can lead to the need to interrupt production. Handle hole edges are also avoided, so that penetration into the handle hole during production can be avoided. Additionally, air movements can no longer lead to the section of the bag in which the handle hole is provided being inflated in parts, thus leading to interruptions in production. Furthermore, the mail-order traders using the delivery bags according to the present disclosure, or the delivery company using these bags, can thus also enjoy increased process reliability. For example, the filling and/or transportation of the bags, in particular also transportation on conveyor belts, is considerably less prone to error.

Figure 1B:
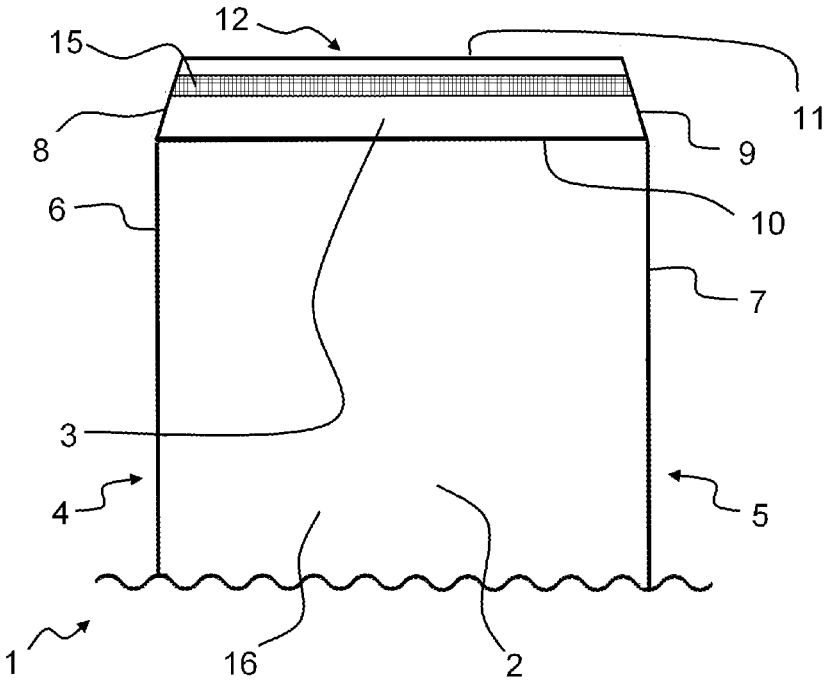

Turning to the drawings, FIGS. 1A and 1B show different embodiments of the upper half 1 of a delivery bag, wherein in each case, the front wall of the bag 2 and an opposite, somewhat longer rear wall of the bag 3 on the upper end of the bag 12 is visible. The upper half 1 of the delivery bag comprises an upper end of the bag 12, a first bag edge 4, and a second bag edge 5. In the illustrated embodiments, the upper edge 10 of the front wall of the bag is lower than the upper edge 11 of the rear wall of the bag. The closable opening lies between the upper edges 10 and 11. The first side edge 6 of the front wall of the bag 2 lies on the first side edge 8 of the rear wall of the bag 3, wherein the latter is somewhat longer in the direction of the upper end of the bag 12. The second side edge 7 of the front wall of the bag 2 lies on the second side edge 9 of the rear wall of the bag 3, wherein the latter is somewhat longer in the direction of the upper end of the bag 12. The first section of the bag 16 is also shown. The second section of the bag is not visible, since it is arranged on the lower half of the delivery bag (see FIGS. 2A to 2C).

The embodiment shown in FIG. 1A shows an embodiment of the upper half 1 of the delivery bag with two adhesive strips 14 and 15 as fasteners. Between the adhesive strips 14 and 15, a destructible line 13 is provided in the form of a weakened line (here, a perforated line). The line 13 can also be separated using scissors, for example. The destruction of the line 13 also destroys the area between the adhesive strips 14 and 15 in the sense of the present disclosure.

The embodiment shown in FIG. 1B shows the upper half 1 of the delivery bag with only one adhesive strip 15 as a fastener. Further, the side walls of the rear wall of the bag 3 are tapered in the area above the upper edge 10, so that side edges 9 and 8 are not linear over the entire length of the bag. This is advantageous for example since the side edges 8 and 9 of the rear wall of the bag 3 cannot stand out on the side in the area above the upper edge 10.

Figure 2A:
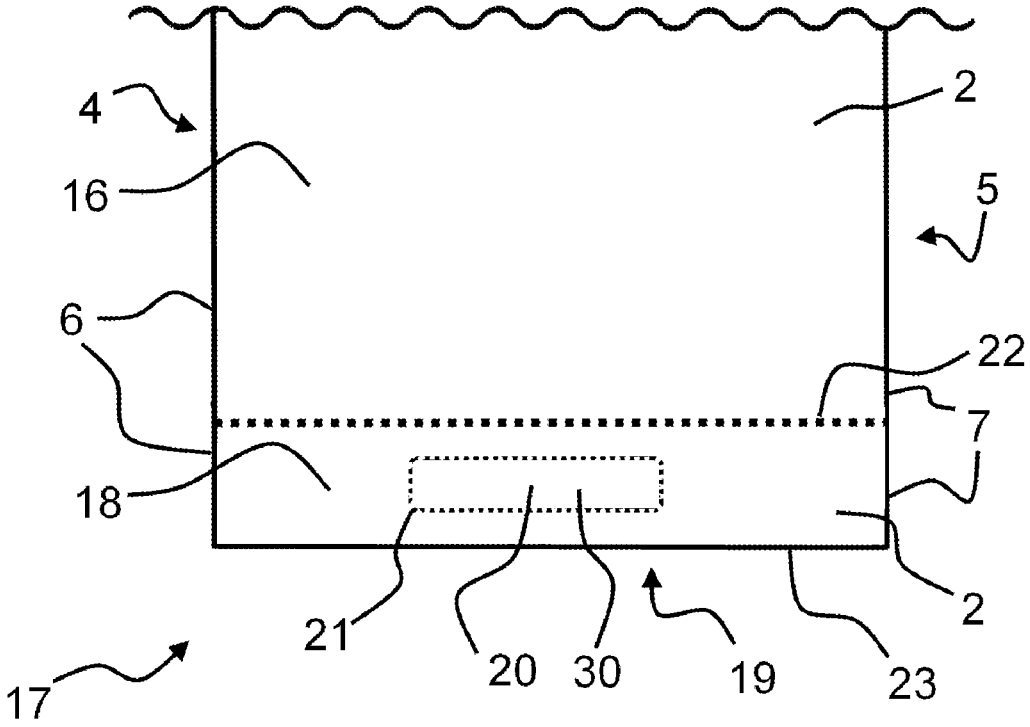
FIGS. 2A-2B show schematic front view of different embodiments of the lower half of the delivery bag.
Figure 2B:
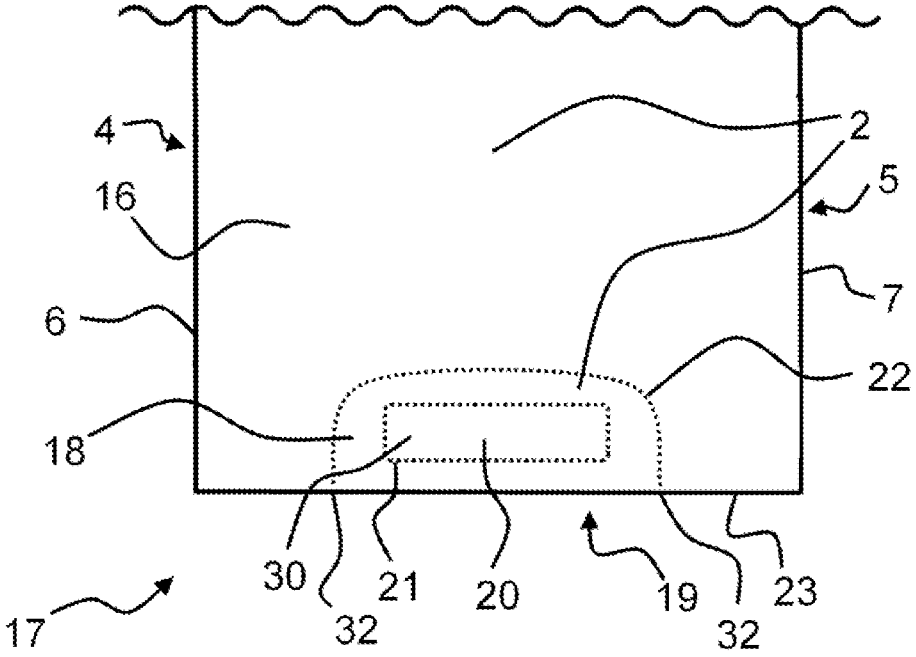

FIGS. 2A and 2B show different embodiments of the lower half 17 of the delivery bag, wherein in each case, the front wall of the bag 2 is visible. The delivery bag comprises a lower end of the bag 19, a first edge of the bag 4, and a second edge of the bag 5. The rear wall of the bag is entirely covered by the front wall of the bag 2 and is thus not visible in the schematic front view. The front wall of the bag 2 comprises the first side edge 6 and the second side edge 7. The delivery bag is divided into a first section of the bag 16 and a second section of the bag 18. The second section of the bag 18 is, in each case, restricted in the embodiments by a first welded seam 22 of the first section of the bag 16. The first welded seam here connects the front wall of the bag 2 and the rear wall of the bag. In the illustrated embodiments, the at least one area for holding goods of the delivery bag is in the first section of the bag 16 between the front wall of the bag and the rear wall of the bag. The second section of the bag 18 comprises a weakened zone for a handle hole 20. The weakened zone for a handle hole is formed by corresponding weakened areas, such as in the form of perforated lines 21 in the front wall of the bag and the rear wall of the bag. On the lower end of the bag 19, the bag comprises a single folding edge 23 (V-fold).

FIG. 2A shows an embodiment in which the first welded seam 22 extends from the first end of the bag 4 to the second end of the bag 5. The weakened zone for a handle hole 20 can be found on the lower end of the bag 19 somewhat centrally between the first welded seam 22 and the folding edge 23.

FIG. 2B shows an embodiment in which the first welded seam 22 comprises a curve so that the weakened zone for a handle hole 20 is encompassed by it from three directions. The position of the weakened zone for a handle hole here largely corresponds to the position shown in FIG. 2A. In FIG. 2B, the connecting points 32 of the welded seam are on the lower edge of the front wall of the bag.

Figure 3A:
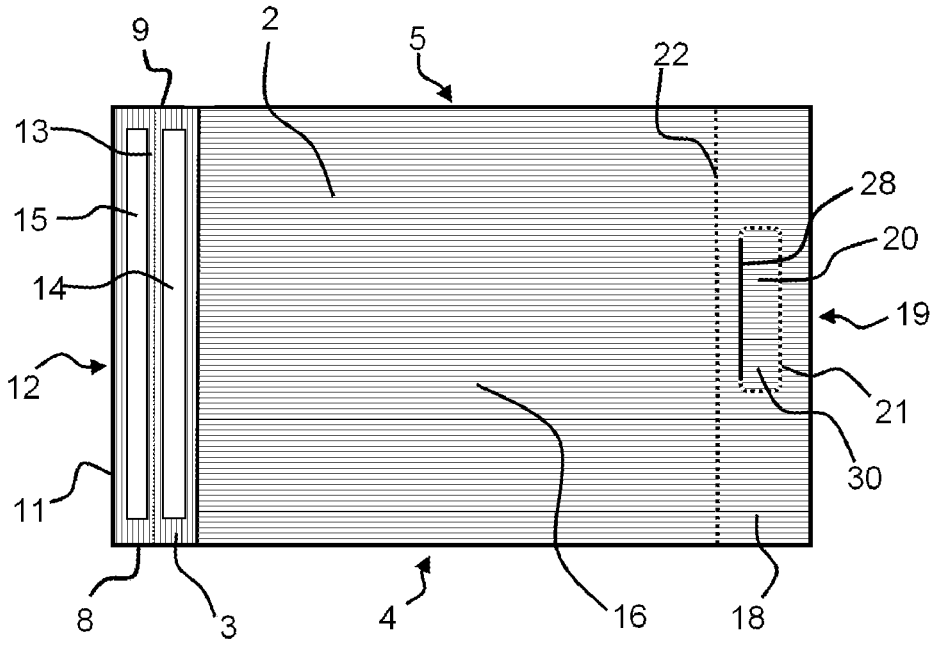
FIGS. 3A-3C show schematic front views of an embodiment of the delivery bag, wherein A) the open bag is shown with a first opening, B) the closed bag is shown, and C) the formation of a second opening is shown.
Figure 3B:
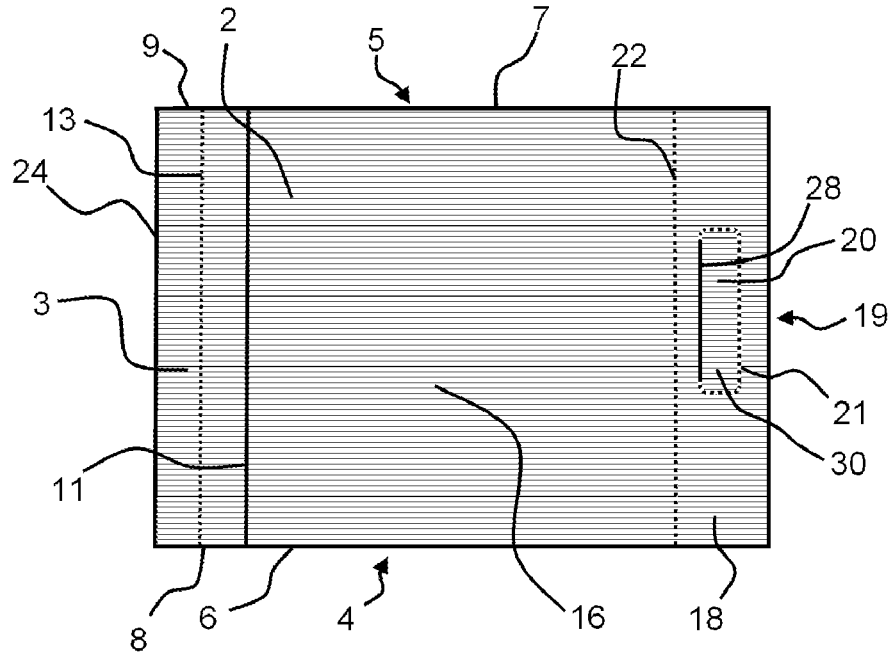
Figure 3C:
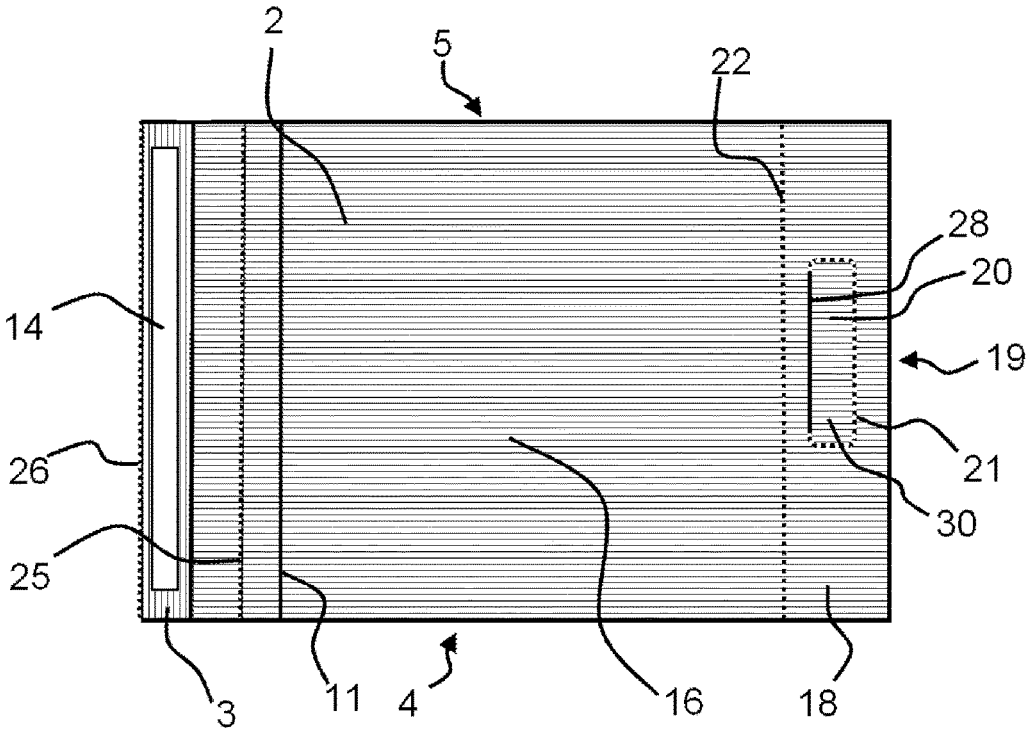

FIG. 3A shows an embodiment of the unclosed delivery bag. The illustrated embodiment can be formed from the upper half in accordance with FIG. 1A and the lower half essentially in accordance with FIG. 2A. Additionally, a stripe pattern has been printed on. The numbering shown in FIGS. 3A to 3C is the same as for FIG. 1A and FIG. 2A. The functional principle of the closing mechanism with two parallel adhesive strips will now be explained with reference to said figures. The bag can be closed with the adhesive strip 15 by removing the film strips of the adhesive strip 15 and folding over said section above the upper edge 8 of the rear wall of the bag 3 onto the front wall of the bag 8, so that the adhesive strip 15 comes into adhesive contact with the front wall of the bag 2.

The bag which has been closed in this manner is shown in FIG. 3B. The folding of the rear wall of the bag 3 onto the front wall of the bag 2 is here made along the folding edge 24. On the rear wall of the bag 3, the destructible line 13 is shown. The line shown here is a perforated line, so that it can be seen on both visible sides of the rear wall of the bag 3.

As shown in FIG. 3C, it is now possible to open the delivery bag, even though the adhesive strip 15 adheres irreversibly, by destroying the area along the destructible line 13. Thus, a new opening is created along the perforated line. The area of the rear wall of the bag which lies between the destructible line 13 and the upper edge 11 remains in contact on the front wall of the bag.

This opening can be re-closed by folding over the section of the rear wall of the bag 3 with the adhesive strip 14 forwards onto the front wall of the bag 2, and closing it using the adhesive strip 14. Thus despite the irreversible adhesion with the adhesive strips 14 and 15, the illustrated embodiment provides an opportunity of opening the bag one single time and re-sealing it. The re-sealed bag visually corresponds largely with the bag shown in FIG. 3B, wherein the destructible line 13 would, in this case, be a destroyed line 13. In contrast to the weakened zone for a handle hole in accordance with FIGS. 2A and 2B, the weakened line 21 is not continuously circumferential. To a far greater extent, a section 28 is provided in the weakened zone for a handle hole which has no perforation and thus result in the fact that after penetration through the weakened zone for a handle hole, the section which covers the handle hole is not entirely released from the bag, but instead remains connected to it via the section 28. In this manner, it can be avoided that the environment with the sections 30 which cover the handle hole become dirty.

It is clear to persons skilled in the art that more adhesive strips are also possible, enabling multiple opening and closure. Such embodiments, with adhesive strips which are interrupted by destructible film areas, are particularly preferred.

The features of the present disclosure disclosed in the above description, in the claims and in the drawings can be essential both individually and in any combination required for the realization of the present disclosure in its different embodiments.

The invention claimed is:

1. A delivery bag, comprising:

an upper bag end, an opposite lower bag end, a first bag edge, and an opposite second bag edge, together with a bag front wall and an opposite bag rear wall, wherein the bag front wall and the bag rear wall respectively comprise an upper edge, a lower edge, a first side edge, and a second side edge, and wherein:

the front wall of the bag and the rear wall of the bag are connected between the upper end of the bag and the lower end of the bag by at least one connecting element, which extends at least partially in the direction from the first edge of the bag to the second edge of the bag, to form a first bag section containing the upper end of the bag, and a second bag section containing the lower end of the bag, the first section of the bag comprises a least one area for holding goods, and only the second section of the bag comprises at least one weakened zone for a handle hole, wherein the weakened zone for a handle hole and the resulting handle hole have an average distance of less than 3 cm and greater than 0.5 cm from the lower edge of the front wall of the bag and/or the rear wall of the bag, the front wall of the bag and/or the rear wall of the bag comprise at least one thermoplastic synthetic material or are made of at least one thermoplastic synthetic material, the delivery bag comprises a first opening to the area for holding goods, which is formed in the first section of the bag between the front wall of the bag and the rear wall of the bag, the delivery bag comprises at least one fastener on the upper end of the bag, wherein said at least one fastener is adapted to irreversibly close the first opening to the area for holding goods, the at least one fastener comprises two adhesive strips at a distance from each other with a weakened line between said strips, the adhesive strip that is closer to the upper end of the bag is usable to irreversibly close the first opening, as a result of destruction of the weakened line between said adhesive strips, a second opening is created to the area for holding goods, the second adhesive strip, which is situated further away from the upper end of the bag, is usable to irreversibly close the second opening, and the rear wall of the bag protrudes on the upper end of the bag over the front wall of the bag such that the protruding section of the rear wall is foldable onto the front wall to close the first opening.

2. The delivery bag according to claim 1, wherein:

the at least one connecting element comprises a first welded seam and/or adhesion line.

3. The delivery bag according to claim 1, wherein:

the delivery bag is a synthetic material delivery bag.

4. The delivery bag according to claim 1, wherein:

the front wall of the bag and/or the rear wall of the bag are water- and/or light-tight.

5. The delivery bag according to claim 1, wherein:

the lower edge of the front wall of the bag of the bag is connected to the lower edge of the rear wall of the bag via a V-shape profile fold.

6. The delivery bag according to claim 1, wherein:

the front wall of the bag and the rear wall of the bag are based on one continuous section of a continuous material strip or on a continuous synthetic material film, wherein the front wall of the bag is also a component of said section of a continuous material strip.

7. The delivery bag according to claim 1, wherein:

the weakened zone for a handle hole comprises a longitudinal extension.

8. The delivery bag according to claim 7, wherein:

the longitudinal extension of the weakened zone for the handle hole extends parallel to the lower edge.

9. The delivery bag according to claim 2, wherein:

the weakened zone for a handle hole is at an average distance of less than 5 cm or less than 4 cm or less than 3 cm from the connecting element or from the first welded seam or adhesion line.

10. The delivery bag according to claim 1, wherein:

the connecting element runs linearly and/or runs in a curve at least in sections.

11. The delivery bag according to claim 10, wherein:

the connecting element runs essentially parallel to the lower edge of the front wall of the bag and/or the rear wall of the bag.

12. The delivery bag according to claim 10, wherein:

the connecting element starts from the lower edge of the front wall of the bag and/or the rear wall of the bag.

13. The delivery bag according to claim 1, wherein:

the second section of the bag has no openings in the front wall of the bag and the rear wall of the bag and/or is essentially rectangular, wherein all four edges of the rectangle are closed.

14. The delivery bag according to claim 1, wherein:

the second bag section of the rear wall of the bag takes up not more than 30% or not more than 25% or not more than 20% of the entire rear wall of the bag.

15. The delivery bag according to claim 1, wherein:

the first edge of the bag is formed by welding the first side edges of the front wall of the bag and the rear wall of the bag to a second welded seam, and the second edge of the bag is formed by welding the second side edges of the front wall of the bag and the rear wall of the bag to a third welded seam, or that the first edge of the bag comprises a second welded seam which runs at a first average distance from the first side edges of the front wall of the bag and the rear wall of the bag, and that the second edge of the bag comprises a third welded seam which runs at a second average distance from the second side edges of the front wall of the bag and the rear wall of the bag.

16. The delivery bag according to claim 15, wherein:
the first average distance and the second average distance are essentially equal.

17. The delivery bag according to claim 16, wherein:
the first average distance and the second average distance are less than 2 cm.

18. The delivery bag according to claim 1, wherein:
the first opening is formed in the front wall of the bag or in the rear wall of the bag.

19. The delivery bag according to claim 1, wherein:
the front wall of the bag has a first length which corresponds to the average distance between the upper edge and the lower edge of the front wall of the bag, and the rear wall of the bag has a second length which corresponds to the average distance between the upper edge and the lower edge of the rear wall of the bag, wherein the first length is shorter than the second length, so that the rear wall of the bag protrudes over the front wall of the bag on the upper end of the bag, and this section which protrudes over the front wall of the bag can be folded onto the front wall of the bag.

20. The delivery bag according to claim 1, wherein:
the rear wall of the bag is larger than the front wall of the bag.

21. The delivery bag according to claim 20, wherein:
the rear wall of the bag is not larger than the front wall of the bag by more than 30% or by not more than 25% or by not more than 20%.

22. The delivery bag according to claim 19, wherein:
the first opening is arranged on the upper end of the bag and can be closed by way of the fact that the section of the rear wall of the bag which protrudes over the front wall of the bag can be folded over onto the front side.

23. The delivery bag according to claim 22, wherein:
the rear wall of the delivery bag comprises at least one reversibly detachable fastener on the upper end of the bag, wherein said at least one fastener following the folding-over of the rear wall of the bag onto the front wall of the bag is designed to close the first opening to the area for holding goods.

24. The delivery bag according to claim 1, wherein:
the weakened line comprises a destructible zone between said adhesive strips.

25. The delivery bag according to claim 24, wherein:
at least one adhesive strip extends from one edge of the bag to the opposite edge of the bag.

26. A method for producing a delivery bag according to claim 1, comprising the following method steps in a variant sequence or in the following sequence:

a) providing a first film strip or film band made of a thermoplastic synthetic material to form the front wall of the bag and the rear wall of the bag;

b) folding the film strip or film band along a folding edge, so that a film area connects the front wall of the bag and the rear wall of the bag on the lower end;

c) forming a welded seam or adhesion line, essentially parallel to the folding edge d) forming at least one weakened zone for a handle hole in the area between the folding edge and the welded seam or the adhesion line; and e) forming two side edges at a distance from each other, essentially orthogonal to the folding edge, by welding the front wall of the bag to the rear wall of the bag, wherein the film band is separated on the side edges, if necessary.

27. The method according to claim 26 wherein:
in step c) the welded seam or the adhesion line is formed essentially parallel to the folding edge at a distance of 1.5 to 15 cm.

28. The method according to claim 26 wherein:
in step d) the at least one weakened zone for a handle hole is created by at least one perforated line.

29. A method of transporting goods for delivery by use of a delivery bag according to claim 1.

30. The method according to claim 29 wherein the goods for delivery are goods for delivery for online or mail order trading.

31. The delivery bag according to claim 1, wherein the weakened zone for a handle hole is formed by a circumferential weakened line which describes a handle hole or by a weakened line which is not fully circumferential, and the weakened line is a perforated line.

32. A delivery bag, comprising an upper bag end, an opposite lower bag end, a first bag edge, and an opposite second bag edge, together with a bag front wall and an opposite bag rear wall, wherein the bag front wall and the bag rear wall respectively comprise an upper edge, a lower edge, a first side edge, and a second side edge, wherein the front wall of the bag and the rear wall of the bag are connected between the upper end of the bag and the lower end of the bag by at least one connecting element, which extends at least partially in the direction from the first edge of the bag to the second edge of the bag, to form a first bag section containing the upper end of the bag, and a second bag section containing the lower end of the bag, wherein the first section of the bag comprises a least one area for holding goods, and only the second section of the bag comprises at least one weakened zone for a handle hole, wherein the weakened zone for a handle hole and the resulting handle hole have an average distance of less than 3 cm and greater than 0.5 cm from the lower edge of the front wall of the bag and/or the rear wall of the bag, wherein the front wall of the bag and/or the rear wall of the bag comprise at least one thermoplastic synthetic material or are made of at least one thermoplastic synthetic material, wherein the front wall of the bag has a first length which corresponds to the average distance between the upper edge and the lower edge of the front wall of the bag, and the rear wall of the bag has a second length which corresponds to the average distance between the upper edge and the lower edge of the rear wall of the bag, wherein the first length is shorter than the second length, so that the rear wall of the bag protrudes over the front wall of the bag on the upper end of the bag, and this section which protrudes over the front wall of the bag can be folded onto the front wall of the bag, and wherein the rear wall of the delivery bag comprises at least one fastener on the upper end of the bag, wherein said at least one fastener following the folding-over of the rear wall of the bag onto the front wall of the bag is adapted to irreversibly close an opening to the area for holding goods.

33. A delivery bag, comprising:

an upper bag end, an opposite lower bag end, a first bag edge, and an opposite second bag edge, together with a bag front wall and an opposite bag rear wall, wherein the bag front wall and the bag rear wall respectively comprise an upper edge, a lower edge, a first side edge, and a second side edge, and wherein:

the front wall of the bag and the rear wall of the bag are connected between the upper end of the bag and the lower end of the bag by at least one connecting element, which extends at least partially in the direction from the first edge of the bag to the second edge of the bag, to form a first bag section containing the upper end of the bag, and a second bag section containing the lower end of the bag, the first section of the bag comprises a least one area for holding goods, and only the second section of the bag comprises at least one weakened zone for a handle hole, wherein the weakened zone for a handle hole and the resulting handle hole have an average distance of less than 3 cm and greater than 0.5 cm from the lower edge of the front wall of the bag and/or the rear wall of the bag, the front wall of the bag and/or the rear wall of the bag comprise at least one thermoplastic synthetic material or are made of at least one thermoplastic synthetic material, the delivery bag comprises a first opening to the area for holding goods, which is formed in the first section of the bag between the front wall of the bag and the rear wall of the bag, the delivery bag comprises at least one fastener on the upper end of the bag, wherein said at least one fastener is adapted to irreversibly close the first opening to the area for holding goods, the at least one fastener comprises two adhesive strips at a distance from each other with a weakened line between said strips, the adhesive strip that is closer to the upper end of the bag is usable to irreversibly close the first opening, as a result of destruction of the weakened line between said adhesive strips, a second opening is created to the area for holding goods, the second adhesive strip, which is situated further away from the upper end of the bag, is usable to irreversibly close the second opening, the front wall of the bag has a first length which corresponds to the average distance between the upper edge and the lower edge of the front wall of the bag, and the rear wall of the bag has a second length which corresponds to the average distance between the upper edge and the lower edge of the rear wall of the bag, the first length is shorter than the second length, so that the rear wall of the bag protrudes over the front wall of the bag on the upper end of the bag, and this section of the rear wall that protrudes over the front wall of the bag is foldable onto the front wall of the bag, and the at least one fastener is adapted to close the first opening to the area for holding goods following the folding-over of the rear wall of the bag onto the front wall of the bag.

* * * * *